United States Patent [19]

Phillipp et al.

[11] 4,221,993

[45] Sep. 9, 1980

[54] DISCHARGE LAMP HAVING MECHANICAL DISCONNECT GUARD AGAINST JACKET FAILURE

[75] Inventors: Robert G. Phillipp, Parma; Wayne R. Hellman, Twinsburg; Wayne C. Matz, Richmond Heights; Walter Bacharowski, Jr., Cleveland, all of Ohio

[73] Assignee: General Electric Company, Schenectady, N.Y.

[21] Appl. No.: 669,192

[22] Filed: Mar. 22, 1976

[51] Int. Cl.[2] ..... H01J 7/44; H01J 17/34; H01J 23/16; H01K 1/62

[52] U.S. Cl. ..... 315/73; 315/74; 315/85

[58] Field of Search ..... 315/73, 74, 75, 107, 315/85, 119, 127, 47

[56] References Cited

U.S. PATENT DOCUMENTS

| | | | |
|---|---|---|---|
| 4,013,920 | 3/1977 | Petro | 315/107 |
| 4,039,893 | 8/1977 | Corbley | 315/73 |
| 4,090,105 | 5/1978 | Koo | 315/74 |
| 4,143,301 | 3/1979 | Strauss et al. | 315/73 |
| 4,156,830 | 5/1979 | Strauss et al. | 315/73 |

FOREIGN PATENT DOCUMENTS

| | | | |
|---|---|---|---|
| 697096 | 9/1953 | United Kingdom | 315/119 |
| 267753 | 4/1970 | U.S.S.R. | 315/74 |

*Primary Examiner*—Saxfield Chatmon, Jr.
*Attorney, Agent, or Firm*—Ernest W. Legree; Lawrence R. Kempton

[57] ABSTRACT

The inner arc tube of some jacketed discharge lamps transmits ultaviolet radiation which is normlly intercepted by the glass outer envelope. To prevent harmful release of such radiation in the event the outer envelope should be shattered, a mechanical disconnect is provided in the interenvelope space comprising a springy conductor fastened to a conductive support and compressed between the outer envelope and an arc tube inlead. Upon fracture of the outer envelope, the conductor straightens out whereupon the circuit is opened and the arc tube is disabled.

3 Claims, 2 Drawing Figures

DISCHARGE LAMP HAVING MECHANICAL DISCONNECT GUARD AGAINST JACKET FAILURE

The invention relates to jacketed discharge lamps of the kind wherein the inner arc tube transmits ultraviolet radiation which is normally absorbed by the glass outer jacket.

BACKGROUND OF THE INVENTION

Some common types of high intensity discharge lamps used for general lighting comprise a quartz or fused silica arc tube enclosed within a glass outer jacket fitted with a screw base at one end. In high pressure mercury vapor lamps the arc tube contains a filling of mercury, whereas in high pressure metal halide lamps, the arc tube contains a filling of mercury and metal halides. In both kinds, the arc tube transmits ultraviolet radiation which is harmlessly absorbed by the glass outer envelope, or even gainfully absorbed by a phosphor coating on the other envelope.

Most commonly the outer envelope remains intact to the end, the lamp life is ended by other factors. However it does happen occasionally that the outer envelope or glass jacket is shattered and the arc tube remains intact so that the lamp continues to operate. In this mode of operation, the ultraviolet radiation from the arc tube is not intercepted and may create a safety hazard.

A solution proposed to this problem by copending application Ser. No. 669,289 of Eugene K. Corbley, filed of even date herewith, now U.S. Pat. No. 4,039,893, titled "Discharge Lamp Having Disconnect Effective Upon Jacket Failure" and assigned like this application, utilizes a mechanical disconnect located in the outer envelope. The disconnect comprises conductors which are part of the arc tube supporting frame and which are held in engagement by the outer envelope. Upon fracture of the outer envelope, spring pressure forces the conductors apart whereupon the circuit is opened and the arc tube is disabled. While this arrangement is effective and achieves its intended purpose, a reliable, simpler and more economical solution is desired.

SUMMARY OF THE INVENTION

The object of the invention is to provide a jacketed discharge lamp which includes improved means for mechanically disconnecting the arc tube in the event the outer envelope is shattered, in order to prevent release of ultraviolet radiation.

In accordance with our invention, a springy conductor is connected to one of a pair of inleads, either a current inlead into the outer envelope or an inlead to an electrode of the arc tube, and is pressed by engagement with the outer envelope into a connection with the other of the pair. The connection with the other inlead of the pair is opened when the outer envelope is shattered.

In a preferred embodiment, a jacketed discharge lamp includes within the outer envelope a mechanical disconnect or switch means comprising a springy conductor fastened to a side rod which supports the arc tube and serves as a connector to one of the current inleads into the outer envelope. The springy conductor is compressed between the outer envelope and a contact attached to an arc tube inlead to provide circuit continuity from the current inlead to the arc tube inlead.

Upon fracture of the outer envelope, the springy conductor expands and straightens out, thereby opening the circuit and disabling the arc tube.

DESCRIPTION OF PREFERRED EMBODIMENT

Figure 1:
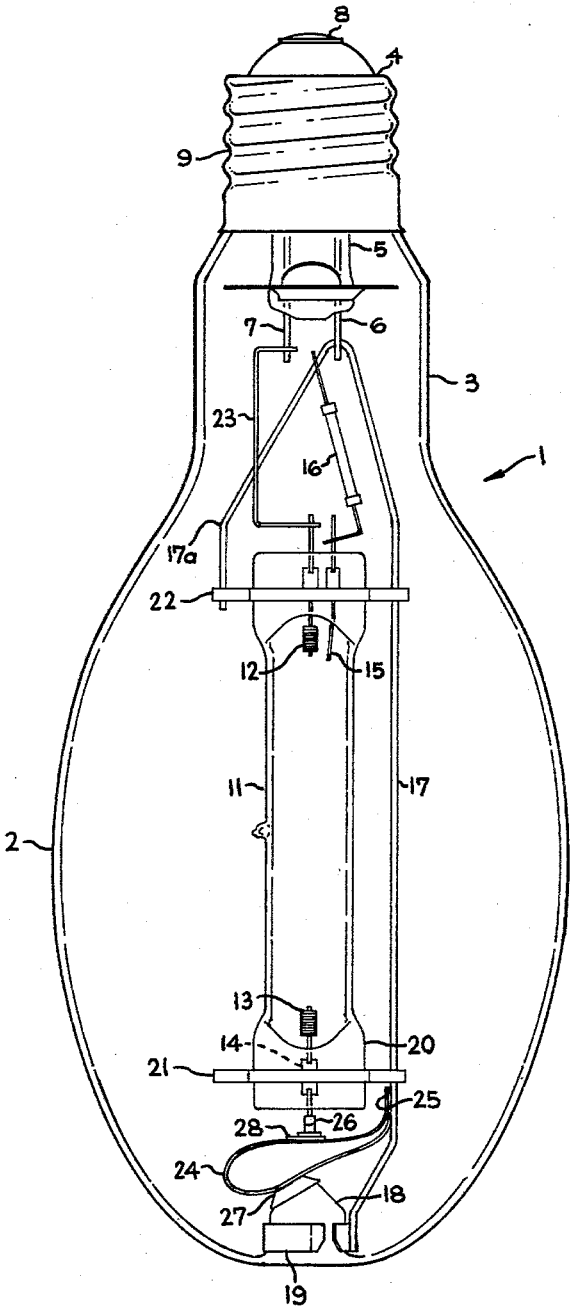
FIG. 1 shows a high pressure metal vapor lamp embodying the invention.

Referring to the drawing and more particularly to FIG. 1, there is shown a high pressure mercury vapor lamp 1 embodying the invention in preferred form. It comprises a glass outer envelope or jacket 2 of ellipsoidal shape having a neck 3 to the end of which is attached a screw type base 4. The neck 3 is closed by a re-entrant stem 5 having a press portion through which extend relatively stiff current inlead wires 6, 7. The current inleads are connected exteriorly to the contact surfaces of the base, namely the insulated center contact or eyelet 8 and the base shell 9.

Inner arc tube 11 is made of fused silica, commonly referred to as quartz, and encloses a charge of mercury and an inert starting gas, suitably argon at a pressure of about 20 torr. In a metal halide lamp, the filling would include additonally small quantities of one or more metallic halides, for instance sodium and scandium iodides. The arc tube is provided at opposite ends with a pair of main discharge supporting electrodes 12,13 to which connections are made by ribbon type inleads 14 sealed through the flattened ends of the tube. A fine tungsten wire 15 sealed into the arc tube at the stem end serves as an auxiliary starting electrode and is connected through a current limiting resistor 16 to inlead 6 by way of side rod 17. The side rod is welded to inlead 6 at the stem end and extends to an anchoring dimple 18 at the dome end of the envelope which it engages by an encircling clip 19. The arc tube is attached to the mount frame by clamping its flat ends 20 between strap clips 21, 22 which are welded to side rod 17, the lower clip being additionally welded to reverted portion 17*a* of the side rod. Electrode 12 is connected to current inlead 7 by conductor 23.

The arc discharge through mercury vapor at a pressure exceeding one atmosphere generates both visible and ultraviolet radiation which is transmitted by fused silica arc tube 11. However, outer envelope 2 is of glass which does not transmit ultraviolet radiation. When the outer envelope is clear, the ultraviolet radiation is merely harmlessly absorbed. In so-called deluxe mercury lamps, the outer envelope is coated internally with a phosphor layer and in such case the ultraviolet radiation is absorbed and converted into visible light including red which improves the color rendition of the lamp. The space within outer envelope 2 may be either evacuated or filled with an inactive gas such as nitrogen.

It is possible for the jacket to be broken away and the arc tube to remain intact. For instance when a conventional lamp is operated base-up, it happens occasionally that the jacket upon being struck by a ball or projectile shatters and falls off without breaking the arc tube or the connections thereto. The lamp may continue to operate in this fashion until the inleads to the arc tube are oxidized and burned through. This may take several hours and in the meantime the ultraviolet radiation from the arc tube is freely radiated and may create a safety hazard.

Our invention eliminates the foregoing possibility by a mechanical disconnect or switch means in the interenvelope space which turns off the arc tube instantaneously. It comprises springy conductor 24 which is formed into a loop and spot welded at 25 to side rod 17 in such manner as to extend between dimple 18 in the jacket and the lower end of the arc tube. When the lamp mount is sealed into the outer envelope, the lower branch of the loop is pressed upward by the dimple and causes the upper branch to bear against silverplated contact button 26 which is attached by crimping to the inlead of electrode 13. A small cup 27 attached to the lower branch of the loop functions as a centering device engaging the conical part of the dimple and serves to stabilize and hold the spring loop in place. A disk or contact plate 28 is attached to the upper branch of the loop and forms a contact surface which securely engages contact 26. The disk assures that the engagement with contact 26 is maintained despite the flexing of mount parts during shipment and handling. As illustrated in FIG. 1, the circuit from the side rod to electrode 13 is completed through loop 24 and remains closed so long as the outer envelope is intact.

Figure 2:
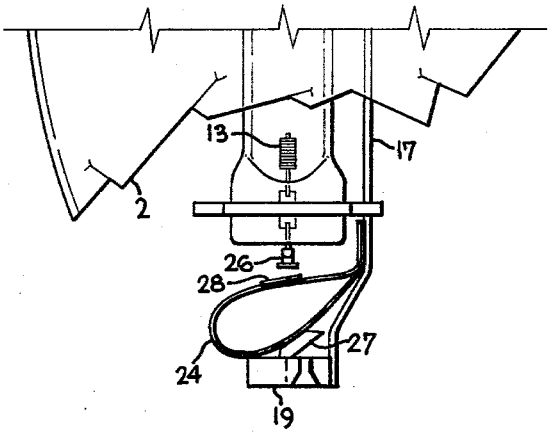
FIG. 2 is a pictorial detail of the mechanical disconnect opened upon outer envelope fracture.

Should the jacket or outer envelope be shattered, the pressure exerted by dimple 18 is removed from the lower branch of the loop. The loop now expands, the branches start to straighten out, and disk 28 moves away from contact 26, thereby opening the circuit, as illustrated in FIG. 2. Desirably, loop conductor 24 has sufficient resiliency to force dimple 18 out of clip 19 should the weight of the fractured jacket itself be insufficient to do so. Thus a broken connection is assured which disables the lamp immediately. Clip 19 limits the extent to which loop conductor 24 straightens out. This is desirable during manufacture of the lamp in order to facilitate engagement of dimple 18 by cup 27 during assembly of the arc tube mount into the outer envelope.

What we claim as new and desire to secure by Letters Patent of the United States is:

1. A jacketed electric lamp comprising:

a sealed vitreous outer envelope having a neck end to which a base is attached and a dome end including an anchoring dimple;

current inleads connected to said base and sealed into said envelope through the neck end;

an inner arc tube of material which transmits ultraviolet radiation within said outer envelope, said arc tube having electrodes and inleads thereto sealed into its ends and containing an ionizable medium productive of radiation including ultraviolet which is normally intercepted at the outer envelope;

a mount frame supporting said inner arc tube within said outer envelope and comprising a side-rod extending from one of the current inleads to the anchoring dimple and means attaching the arc tube to the side rod;

and means connecting the electrode inleads of the arc tube to said current inleads comprising said side-rod and a springy conductor formed into a loop attached thereto and compressed between said dimple and a contact attached to the arc tube inlead close to said dimple, one branch of the loop pressing against said dimple and the other branch pressing against said contact, said springy conductor providing circuit continuity only so long as said outer envelope is intact and maintains it compressed.

2. A lamp as in claim 1 wherein said one branch of the loop has a cup attached to it and adapted to bear against said dimple as a centering device in order to stabilize the loop in place.

3. A lamp as in claim 1 wherein said other branch of the loop has a plate attached to it and adapted to bear against said contact whereby to assure contact despite flexing of mount parts.

* * * * *